United States Patent [19]

Kamleitner

[11] 4,297,979

[45] Nov. 3, 1981

[54] SPLIT CONTROL RACK

[75] Inventor: Ewald Kamleitner, Friedrichshafen, Fed. Rep. of Germany

[73] Assignee: Motoren- und Turbinen-Union Friedrichshafen GmbH, Friedrichshafen, Fed. Rep. of Germany

[21] Appl. No.: 38,713

[22] Filed: May 14, 1979

[30] Foreign Application Priority Data

May 13, 1978 [DE] Fed. Rep. of Germany ..... 2821161

[51] Int. Cl.[3] ..... F02D 17/00

[52] U.S. Cl. ..... 123/372; 123/198 F

[58] Field of Search ..... 123/198 F, 140 R

[56] References Cited

U.S. PATENT DOCUMENTS 1,967,101 7/1934 Rassbach et al. ..... 123/198 F X 2,431,516 11/1947 Starr ..... 123/198 F

FOREIGN PATENT DOCUMENTS 52-54836 5/1977 Japan ..... 123/198 F

*Primary Examiner*—Tony M. Argenbright

*Attorney, Agent, or Firm*—Craig and Antonelli

[57] ABSTRACT

A split control rack, actuated by a control member, for fuel injection pumps arranged in a series and within a common housing. Pump pistons of the injection pumps are provided with oblique control edges and are adapted to be rotated by a control rack through serrations or guide levers in order to vary an amount of fuel conveyed. The fuel injection pumps are associated with cylinders of a reciprocating-piston internal combustion engine with a first group of cylinders being supplied with fuel in dependence upon a displacement of a first control rack section and a second group of cylinders being supplied with fuel in dependence upon a displacement of a second control rack section. The two control rack sections each consist of individual segments equipped with serrations or guide levers and joined together by rod-like elements with the rod-like element of one control rack section being guided in corresponding recesses or the like of the segments of the other control rack section.

7 Claims, 4 Drawing Figures

34
33
21
24
11
14
21
34
24
11
14
31
21
24
11
14
21
24
11
14
0
V
36
35
32

11
13
I
I
14
12
22

12
21
24
23
22

11
II
14
II
31
12
22
21
24
III
III 11
14

SPLIT CONTROL RACK

The present invention relates to a control arrangement and, more particularly, to a split control rack which is adapted to be actuated by a control member for controlling an operation of fuel injection pumps arranged in a series and disposed within a common housing with pump pistons of these injection pumps, provided with an oblique control edge, being adapted to be rotated by the control rack through serrations or guide levers in order to vary an amount of fuel being conveyed and with these fuel injection pumps being associated with cylinders of a reciprocating-piston internal combustion engine, which cylinders are divided into first and second groups with a first group of the cylinders being supplied with a fuel in dependence on a displacement of a first control rack section and a second group of cylinders being supplied with fuel in dependence upon a displacement of a second control rack section.

In internal combustion engines, it has been proposed to shut off a first group of cylinders of the engine by cutting off a fuel supply to said cylinders during, for example, idling and partial load operations, so that the remaining cylinders of a second group of cylinders are placed under a correspondingly higher load. By virtue of such an operation of an internal combustion engine, a higher degree of efficiency is obtained and the internal combustion engine operates more economically. Moreover, a more complete combustion is attained thereby resulting in more favorable exhaust gas emission values. Furthermore, a lubricating oil dilution by noncombusted fuel, which frequently occurs during longer periods of idling operation with all cylinders, is avoided.

In German Pat. No. 499,871, a series injection pump arrangement for internal combustion engines is proposed wherein a transversely divided control rack is provided for varying in different or like fashion a conveying quantity of the individual pumps in two groups of injection pumps.

By a transverse division of the control rack such as proposed in the aforementioned patent, a fixed determination exists as to which pumps and, consequently, which cylinders of the internal combustion engine will be shut off during partial load operation and it is impossible, especially with existing internal combustion engines and fuel injection pumps, to effect a correlation of the individual cylinders to one or the other group which correlation is extremely desirable when considering the technical aspect of a vibration analysis of the engine operating with one or more of the cylinders shut off. Moreover, an installation of a transversely divided control rod in already existing pump arrangements requires a special construction for economical reasons and is also for all practical purposes impossible.

In German Pat. No. 1,576,591, a control rack is proposed which is divided in a longitudinal direction so that two racks are arranged nestled into each other and are displaceable slidingly with respect to each other in a longitudinal direction. A disadvantage of this proposed construction resides in the fact that the pinions of the two groups of fuel injection pumps, to be operated differently from each other, must be disposed in different planes. Consequently, this proposed arrangement cannot be utilized with already existing fuel injection pumps. Moreover, a toothed width of gear teeth of the control rack and pinion, with the same amount of space being available, now becomes only half as large so that a greater wear and tear on the gear teeth must be expected.

The aim underlying the present invention essentially resides in providing a split control rack which is readily installable in existing series of fuel injection pumps by which the individual injection pumps and also the individual cylinders associated with first and second cylinder groups can optimally be controlled in dependence upon vibration analysis considerations.

In accordance with advantageous features of the present invention, two control rack sections are provided each of which includes individual sections provided with serrations or guide levers and being joined together by rod-like elements with the rod-like element of one control rack being guided in corresponding recesses of the segments of the other control rack section.

By virtue of a control rack constructed in accordance with the present invention, it is possible to install a split control rack in existing series injection pumps without increasing the space requirement and without substantial secondary work whereby a correlation of the individual pump elements and thus the associated cylinders with the two cylinder groups may readily take place without any restrictions. Moreover, the original toothed widths of the pinions and the gears of the injection pumps can be retained.

To obtain a secure mutual guidance in a simple manner from a manufacturing point of view, in accordance with the present invention, the rod-like connecting element of the first control rack section has a circular cross section and is mounted in corresponding bores of the segments of the first control rack section and is also slidingly guided in corresponding bores of the segments of the second control rack section, the rod-like connecting element of the second control rack section has a rectangular cross section and is mounted in corresponding grooves of the segments of the second control rack section and is also slidingly guided in corresponding grooves of the segments of the first control rack section.

Accordingly, it is an object of the present invention to provide a split control rack arrangement for fuel injection pumps of an internal combustion engine which avoids, by simple means, shortcomings and disadvantages encountered in the prior art.

Another object of the present invention resides in providing a split control rack arrangement for fuel injection pumps of an internal combustion engine which can be readily installed in existing fuel injection pumps. Another object of the present invention resides in providing a split rack control arrangement for fuel injection pumps of an internal combustion engine by which it is possible to effect a correlation between the cylinders of the internal combustion engine so as to obtain an optimum balancing of vibrational forces when fuel to one or more of the cylinders of the internal combustion engine is interrupted.

Yet another object of the present invention resides in providing a split control rack arrangement for fuel injection pumps of an internal combustion engine which minimizes the wear and tear of the gear means of the rack and fuel injection pumps.

A further object of the present invention resides in providing a split control rack arrangement which functions reliably under all operating conditions.

A still further object of the present invention resides in providing a split rack control arrangement for fuel injection pumps of an internal comubustion engine which is simple in construction and therefore relatively inexpensive to manufacture.

These and other objects, features, and advantages of the present invention will become more apparent from the following description when taken in connection with the accompanying drawings which show, for the purposes of illustration only, one embodiment in accordance with the present invention, and wherein.

Figures 1, 2, 3, 4:
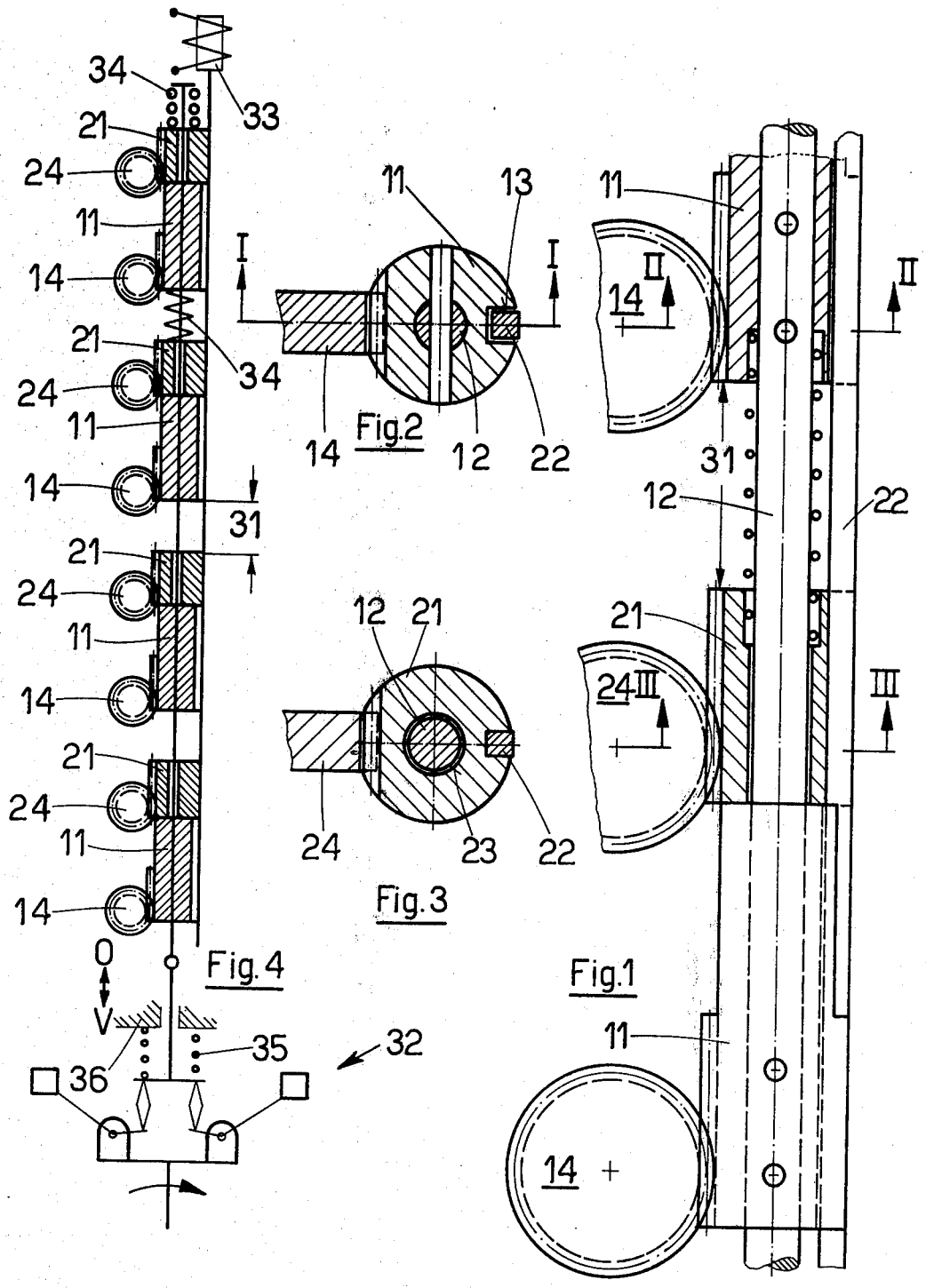
FIG. 1 is a partially schematic cross sectional view of a portion of a split control rack arrangement in accordance with the present invention taken along the line I—I in FIG. 2.
FIG. 2 is a cross sectional view of a split rack control arrangement taken along the line II—II in FIG. 1.
FIG. 3 is a cross sectional view of a split rack control arrangement taken along the line III—III in FIG. 1.
FIG. 4 is a partially schematic cross sectional view of an entire split rack control arrangement for fuel injection pumps in accordance with the present invention.

Referring now to the drawings wherein like reference numerals are used throughout both views to designate like parts and, more particularly, to FIG. 1, according to this Figure, two control rack sections are provided each of which includes individual toothed or serrated segments 11 for actuating a first group of pump pistons (not shown) of fuel injection pumps and toothed segments 21 for actuating a second group of pump pistons (not shown) of fuel injection pumps. A rod-like element 12 having a circular cross section is provided for connecting the segments 11 together with the rod-like element 12 being slidably guided in bores 23 in the toothed segments 21. A further rod-like element 22 having a rectangular cross section is provided for connecting the segments 21 together with the further rod-like element 22 being slidably guided in corresponding grooves 13 (FIG. 2) provided in the segments 11.

As shown more clearly in FIGS. 2 and 3, the toothed segments 11, 21 engage pinions 14, 24 by rotating the pump pistons with the pinions 14 being associated with a first group of pump pistons and the pinions 24 being associated with a second group of pump pistons. In the illustrated embodiment, the toothed segments 11, 21 are arranged in a regular alternating pattern with respect to each other. However, as can be appreciated, other distributions of the toothed segments 11, 21 is likewise possible.

The two control rack sections formed from toothed segments 11, 21, and rod-like elements 12, 22 can be shifted with respect to each other in a longitudinal direction by a distance designated by the reference numeral 31.

As shown in FIG. 4, the first of the two control rack sections provided with the serrated segments 11 and rod-like element 12 is connected directly to a control member such as, for example, a centrifugal flyweight governor generally designated by reference numeral 32 so as to enable an adjusting of a filling or fuel feed of the internal combustion engine. The second control rack section provided with the serrated segments 21 and rod-like elements 22 may be selectively retained in the illustrated "zero" filling position or may be released by means of, for example, an electrically operable solenoid 33. The second control rack section is connected to the first control rack section in a shape-mating fashion upon a movement of the first control rack section in a direction toward the "zero filling" position and by one or more compression springs 34 upon a movement of the first control rack section in a direction toward a "full filling" position.

Upon a setting of "partial filling" quantity the first control rack section is displaced in a direction toward a "full filling" by, for example, changing a bias of a controller spring 35 by way of an adjustment of an adjustable stop 36. Thus, the cylinders of the first group of cylinders of the internal combustion engine are supplied with fuel. The second control rack section is retained in the position for "zero filling" by means of a solenoid 33. Thereby, the fuel supply to the corresponding remaining cylinders of the second group of cylinders of the internal combustion engine is shut off or interrupted. In FIG. 4, the doubleheaded arrow provides an illustration of the displacement direction of the split control rack for a zero load designated zero ("zero filling") and for a full load designated V ("full filling").

Upon a dropping off or deenergization of the solenoid 33 which may take place, for example, in dependence upon a position of the adjustable stop 36, that is, in dependence upon the existence of a certain load stage, the second control rack section is released and coupled to the first control rack section by way of the compression spring 34 whereby the second cylinder group is likewise supplied with fuel and the internal combustion engine may be operated with all the cylinders until the maximum or "full filling" of the cylinders has been reached. Once again to disconnect a part or group of these cylinders, the solenoid 33 is energized whereby the second control rack section is pulled against the force of these compression spring 34 into a position for a "zero filling". This renewed shut off step of a group of cylinders may be carried out manually by, for example, actuation of a switch but is preferably effected automatically by suitable control means constructed in a conventional manner whereby the shut off is effected in dependence upon an adjustment of the various load stages of the internal combustion engine.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A split control rack for controlling an operation of a series of fuel injection pump means which are respectively associated with cylinders of an internal combustion engine, the split control rack including a first control rack section associated with a first group of cylinders and a second control rack section associated with a second group of cylinders, the split control rack being displaceably actuated by a control member such that the fuel is supplied to the first group of cylinders in dependence upon a displacement of the first control rack section and fuel is supplied to the second group of cylinders in dependence upon a displacement of the second control section rack, characterized in that each of the two control rack sections includes a plurality of individual cylindrical segments each being respectively associated with one of the fuel injection pump means, each of the individual segments is provided with one of serrations and guide levers for actuating the respective fuel pump means associated with the individual segments a first rod is provided for connecting each of the individual sections of the first control rack section together, means are provided in each of the individual segments of the second control rack section for enabling a displaceable mounting of the individual segments of the second rack section on the first rod, a second rod is provided for connecting each of the individual segments of the second control rack section together, and in that recess means are provided in each of the individual segments of the second control rack section for guidingly accommodating the first rod connecting the individual segments of the first control control rack section together.

2. A split control rack for controlling an operation of a series of fuel injection pump means which are respectively associated with cylinders of an internal combustion engine, the split control rack including a first control rack section associated with a first group of cylinders and a second control rack section associated with a second group of cylinders, the split control rack being displaceably actuated by a control member such that fuel is supplied to the first group of cylinders in dependence upon a displacement of the first control rack section and fuel is supplied to the second group of cylinders in dependence upon a displacement of a second control rack section, characterized in that each of the two control rack sections includes a plurality of individual segments, each of the segments is provided with one of serrations and guide levers for actuating the fuel pump means, a first rod-like connecting means having a circular cross sectional configuration is provided for connecting the segments of the first control rack section together, bore means are provided in the individual segments of the first control rack section for enabling a mounting of the segments of the first control rack section on the first rod-like connecting means, a second rod-like means having a rectangular cross sectional configuration is provided for connecting each of the individual segments of the second control rack together, means are provided in each of the individual segments of at least one of the control rack sections for guidingly accommodating the first rod-like connecting means of the other control rack section, said accommodating means includes bore means provided in the individual segments of the second control rack section for slidably guiding the first rod-like connecting means, groove means are provided in the individual segments of the second control rack section for enabling a mounting of the segments of the second control rack section on the second rod-like connecting means, and in that said accommodating means further includes groove means provided in the individual segments of the first control rack section for slidably guiding the second rod-like connecting means.

3. A split control rack according to one of claims 1 or 2, characterized in that means are provided for controlling and positioning of one of the control rack sections so as to enable a selective interruption of a supply of fuel to one of the groups of cylinders of the internal combustion engine in dependence upon an operational stage of the internal combustion engine.

4. A split control rack according to claim 3, characterized in that said controlling means includes a selectively operable electromagnetic means operatively connected with one of the control rack sections for holding the rack section in a predetermined position thereby interrupting a supply of fuel to the group of cylinders associated with such control rack section.

5. A split control rack according to claim 4, characterized in that means are provided for coupling of the control rack sections together upon a deenergization of the electromagnetic means.

6. A split control rack according to claim 5, characterized in that said coupling means includes at least one compression spring means for urging the individual segments of the respective rack sections into engagement.

7. A split control rack according to claim 5, characterized in that the series of fuel injection pump means are disposed in a common housing, each of the fuel pump means includes a pump piston means provided with an oblique control edge, and in that each pump piston means is adapted to be rotated in response to a displacement of the split control rack so as to vary a quantity of fuel supply to the cylinders of the internal combustion engine.

* * * * *